US006477925B2

(12) United States Patent
Lin

(10) Patent No.: US 6,477,925 B2
(45) Date of Patent: Nov. 12, 2002

(54) PLIERS

(75) Inventor: Chang-Chuan Lin, Gia Yi Hsien (TW)

(73) Assignee: Yi Jin Technology Co., Ltd., Gia Yi Hsien (TW)

( * ) Notice: Subject to any disclaimer, the term of this patent is extended or adjusted under 35 U.S.C. 154(b) by 0 days.

(21) Appl. No.: 09/795,566

(22) Filed: Feb. 28, 2001

(65) Prior Publication Data

US 2002/0117029 A1 Aug. 29, 2002

(51) Int. Cl.[7] ..... B25B 7/02
(52) U.S. Cl. ..... 81/423; 81/185.1
(58) Field of Search ..... 87/185.1, 423

(56) References Cited

U.S. PATENT DOCUMENTS 5,469,766 A * 11/1995 Hodges ..... 81/423 X
5,542,167 A * 8/1996 Nakamoto ..... 81/423 X
5,579,667 A * 12/1996 Kim ..... 81/423 X
5,590,573 A * 1/1997 Detable ..... 81/423 X
5,884,540 A * 3/1999 Mo ..... 81/423

* cited by examiner

*Primary Examiner*—James G. Smith
(74) *Attorney, Agent, or Firm*—Alan D. Kamrath; Rider, Bennett, Egan & Arundel

(57) ABSTRACT

A pair of pliers has a pair of jaw support frames engaging with each other, and two jaw blocks. Each jaw block has a mount having at least a round hole, a ball, a spring, and a threaded disk. The ball, the spring and the threaded disk are inserted in the round hole of the mount. Each jaw support frame has two parallel plates and a spacing defined between the parallel plates. Each plate has at least a through hole. Each mount is inserted in the corresponding spacing of the jaw support frame.

1 Claim, 9 Drawing Sheets

PLIERS

BACKGROUND OF THE INVENTION

The present invention relates to a pair of pliers. More particularly, the present invention relates to a pair of pliers which has two jaw blocks to be detached easily.

Referring to FIG. 1, a pair of conventional pliers 5 has two jaws 51 and two cutters 52 disposed on two jaws 51. Since the jaws 51 and the cutters 52 are fastened together, it is difficult to detach the cutters 52 from the jaws 51.

SUMMARY OF THE INVENTION

An object of the present invention is to provide a pair of pliers which has two jaw blocks to be detached easily.

Accordingly, a pair of pliers comprises a pair of jaw support frames engaging with each other and two jaw blocks. Each of the jaw support frames has two parallel plates and a spacing defined between the parallel plates. Each mount is inserted in the corresponding spacing of the jaw support frame.

In accordance with a first preferred embodiment of the present invention, a pair of pliers comprises a pair of jaw support frames engaging with each other, and two jaw blocks. Each of the jaw blocks has a mount having at least a round hole, a ball, a spring, and a threaded disk. The ball, the spring and the threaded disk are inserted in the round hole of the mount. Each of the jaw support frames has two parallel plates and a spacing defined between the parallel plates. Each of the plates has at least a through hole. Each mount is inserted in the corresponding spacing of the jaw support frame.

In accordance with a second preferred embodiment of the present invention, a pair of pliers comprises at least a jaw support frame and at least a jaw block. The jaw block has a mount having two blind holes. The jaw support frame has two parallel plates and a spacing defined between the parallel plates. Each of the plates has two through holes and two threaded apertures. The mount is inserted in the corresponding spacing of the jaw support frame. A panel has two threaded holes, an oblong recess, and an oblong groove. A spring is inserted in the oblong recess of the panel. An oblong bar is inserted in the oblong recess and the oblong groove of the panel. The oblong bar has two recess holes. Two balls are inserted in the through holes of one of the plates. The panel and one of the plates are fastened together.

In accordance with a third preferred embodiment of the present invention, a pair of pliers comprises at least a jaw support frame and at least a jaw block. The jaw block has a mount having a first magnet. The jaw support frame has two parallel plates and a spacing defined between the parallel plates. The mount is inserted in the corresponding spacing of the jaw support frame. Each of the plates has a second magnet attracting the first magnet.

In accordance with a fourth preferred embodiment of the present invention, a pair of pliers comprises at least a jaw support frame and at least a jaw block. The jaw block has a mount having a first recess and a first groove. The jaw support frame has two parallel plates, a shaft disposed between the parallel plates, a hooking ring connected to the the parallel plates, and a spacing defined between the parallel plates. The mount is inserted in the corresponding spacing of the jaw support frame. Each of the plates has a second recess. The shaft is inserted in the first groove of the mount. The hooking ring is inserted in the second recess of the plate.

In accordance with a fifth preferred embodiment of the present invention, a pair of pliers comprises at least a jaw support frame and at least a jaw block. The jaw block has a mount having two recesses and a slot. The jaw support frame has two parallel plates and a spacing defined between the parallel plates. The mount is inserted in the corresponding spacing of the jaw support frame. Each of the plates has a groove. A flexible ring is inserted in the slot of the mount. The flexible ring has two protruded blocks and two curved portions.

DETAILED DESCRIPTION OF THE INVENTION

Figure 1:
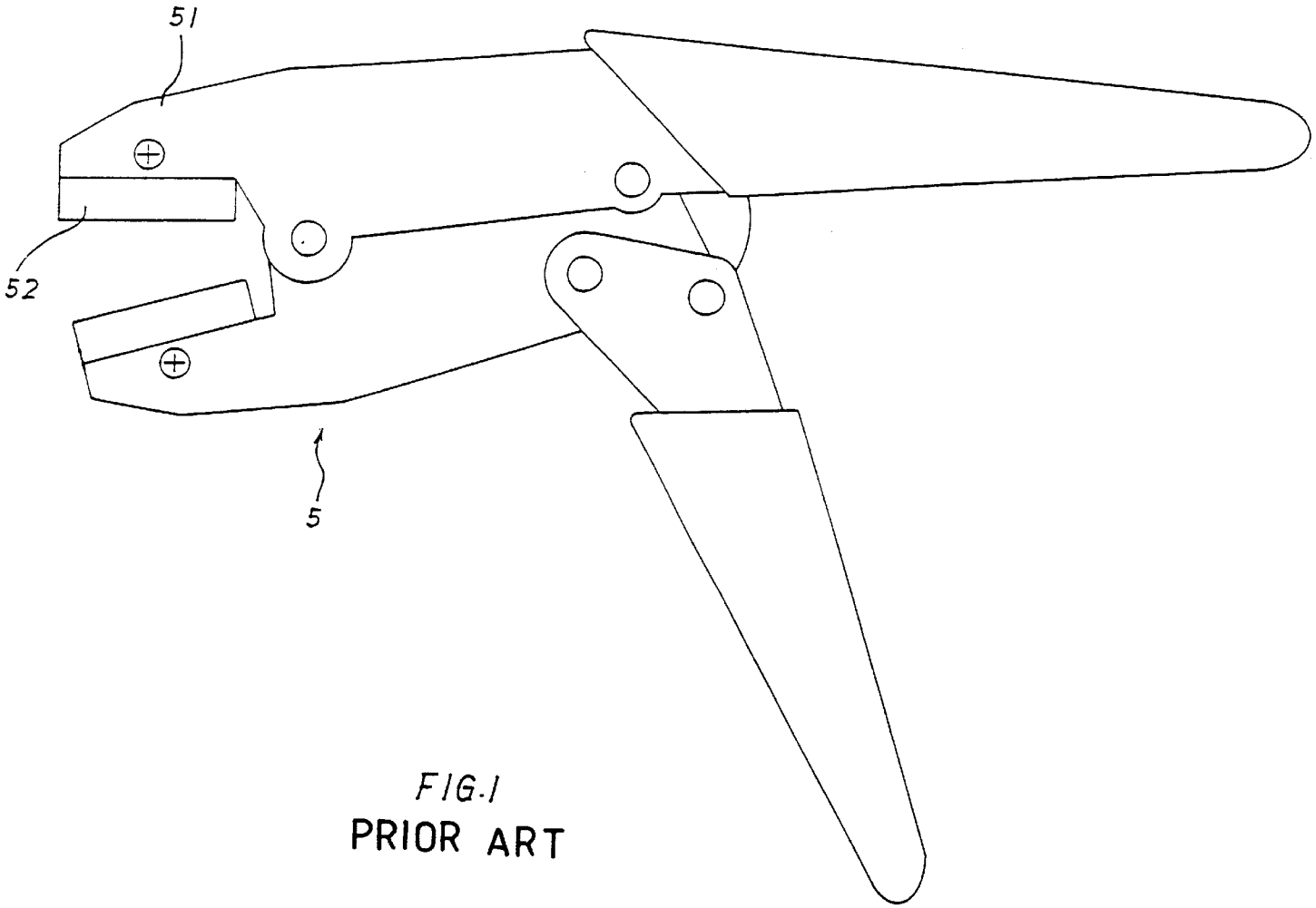
FIG.1 PRIOR ART
FIG. 1 is an elevational view of a pair of pliers of the prior art.
Figure 2:
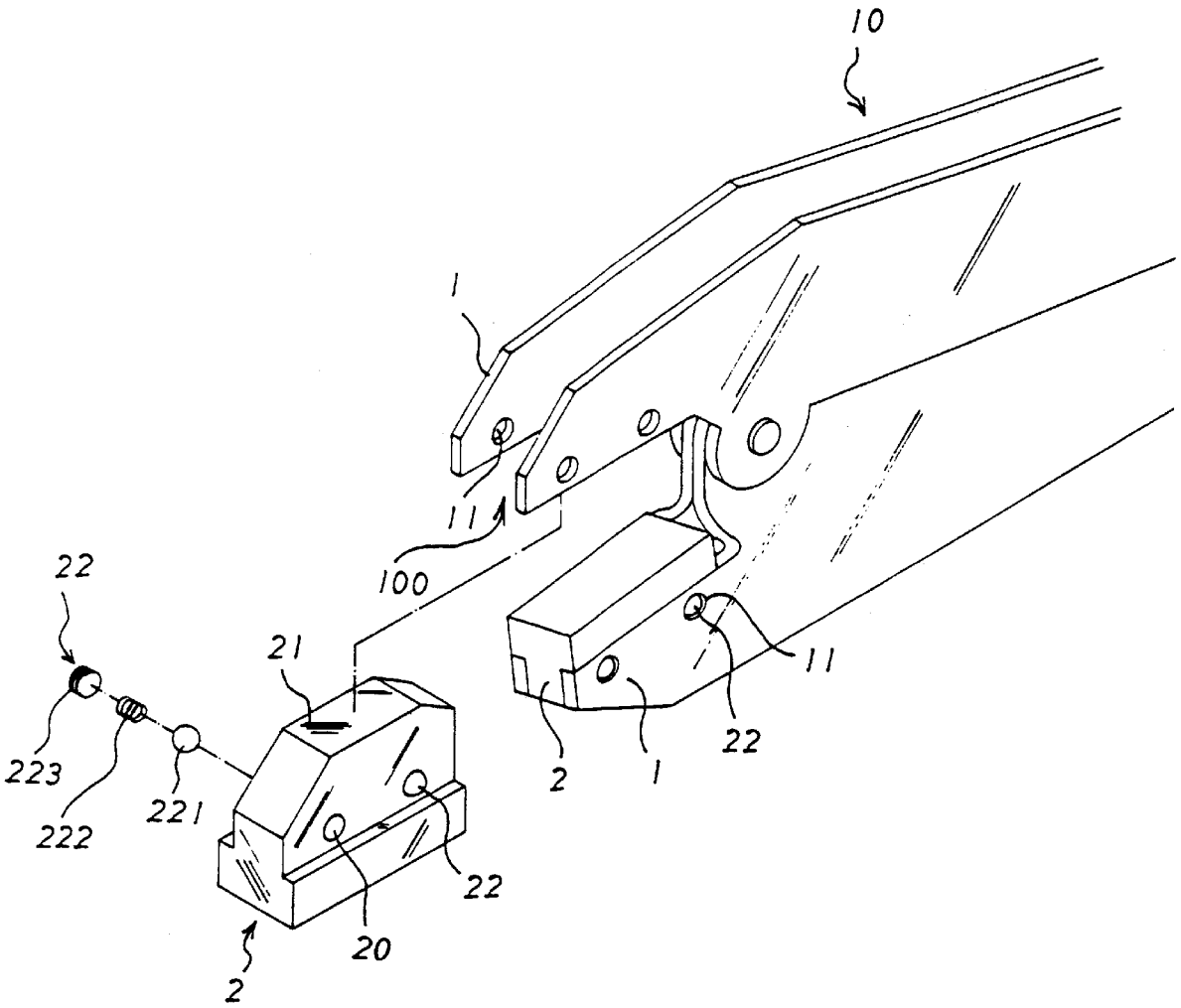
FIG. 2 is a partially perspective exploded view of a pair of pliers of a first preferred embodiment in accordance with the present invention.

Referring to FIG. 2, a first pair of pliers comprises a pair of jaw support frames 10 engaging with each other, and two jaw blocks 2.

Each of the jaw blocks 2 has a mount 21 having at least a round hole 20, a ball 221, a spring 222, and a threaded disk 223.

The ball 221, the spring 222 and the threaded disk 223 which comprise a detached device 22 are inserted in the round hole 20 of the mount 21.

Each of the jaw support frames 10 has two parallel plates 1 and a spacing 100 defined between the parallel plates 1.

Each of the plates 1 has at least a through hole 11.

Each mount 21 is inserted in the corresponding spacing 100 of the jaw support frame 10.

Figure 3:
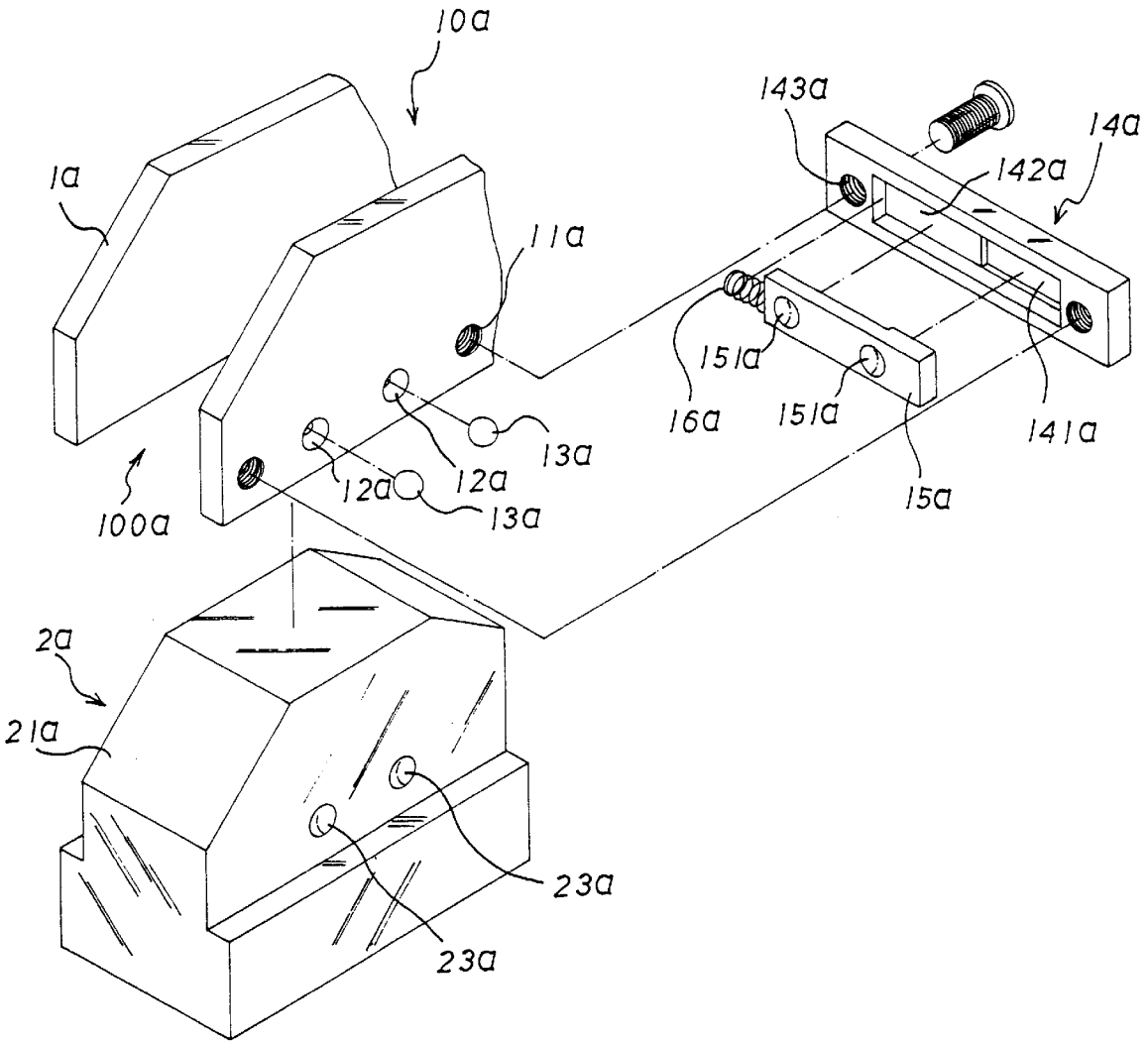
FIG. 3 is a partially perspective exploded view of a pair of pliers of a second preferred embodiment in accordance with the present invention.
Figure 4:
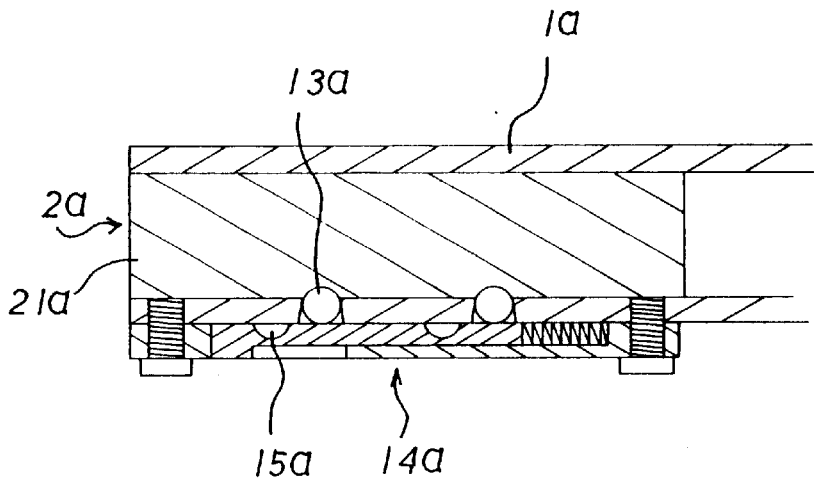
FIG. 4 is a partially sectional assembly view of a pair of pliers of a second preferred embodiment in accordance with the present invention.
Figure 4A:
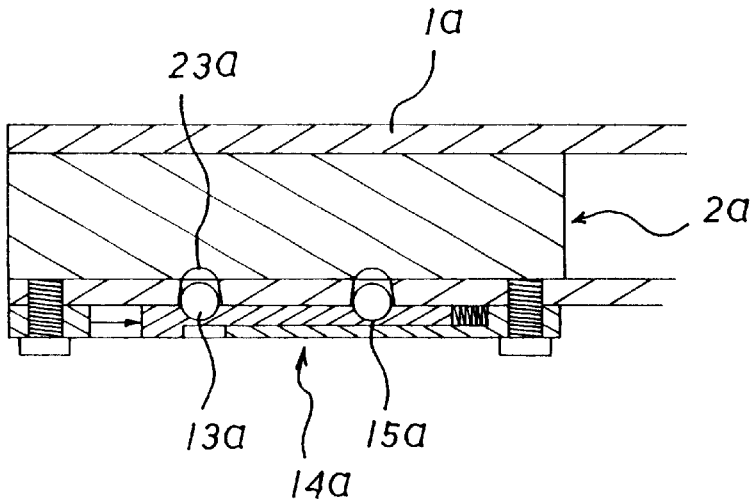
FIG. 4A is another partially sectional assembly view of a pair of pliers of a second preferred embodiment in accordance with the present invention.

Referring to FIGS. 3, 4 and 4A, a second pair of pliers comprises at least a jaw support frame 10*a* and at least a jaw block 2*a*.

The jaw block 2*a* has a mount 21*a* having two blind holes 23*a*.

The jaw support frame 10*a* has two parallel plates 1*a* and a spacing 100*a* defined between the parallel plates 1*a*.

Each of the plates 1*a* has two through holes 12*a* and two threaded apertures 11*a*.

The mount 21*a* is inserted in the corresponding spacing 100*a* of the jaw support frame 10*a*.

A panel 14*a* has two threaded holes 143*a*, an oblong recess 142*a*, and an oblong groove 141*a*.

A spring 16*a* is inserted in the oblong recess 142*a* of the panel 14*a*.

An oblong bar 15*a* is inserted in the oblong recess 142*a* and the oblong groove 141*a* of the panel 14*a*.

The oblong bar 15*a* has two recess holes 151*a*.

Two balls 13*a* are inserted in the through holes 12*a* of one of the plates 1*a*.

The panel 14*a* and one of the plates 1*a* are fastened together.

Figure 5:
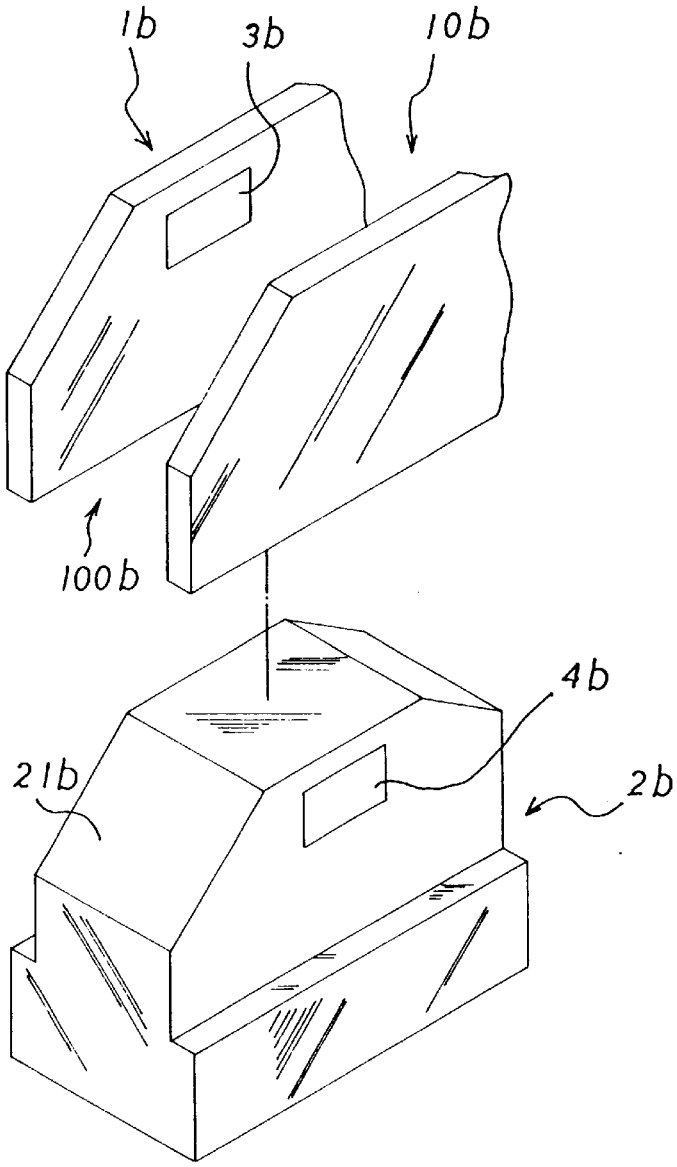
FIG. 5 is a partially perspective exploded view of a pair of pliers of a third preferred embodiment in accordance with the present invention.

Referring to FIG. 5, a third pair of pliers comprises at least a jaw support frame 10*b* and at least a jaw block 2*b*.

The jaw block 2*b* has a mount 21*b* having a first magnet 4*b*.

The jaw support frame 10*b* has two parallel plates 1*b* and a spacing 100*b* defined between the parallel plates 1*b*.

The mount 21*b* is inserted in the corresponding spacing 100*b* of the jaw support frame 10*b*.

Each of the plates 1*b* has a second magnet 3*b* attracting the first magnet 4*b*.

Figure 6:
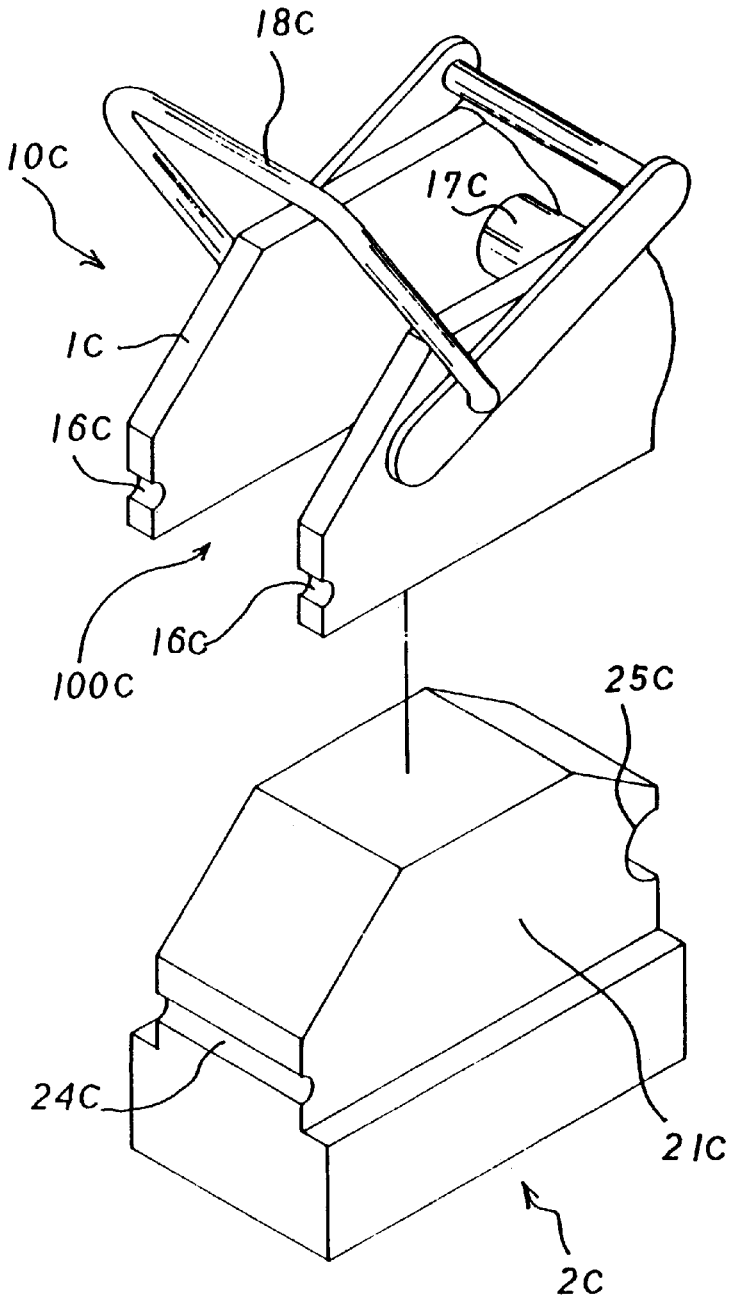
FIG. 6 is a partially perspective exploded view of a pair of pliers of a fourth preferred embodiment in accordance with the present invention.
Figure 7:
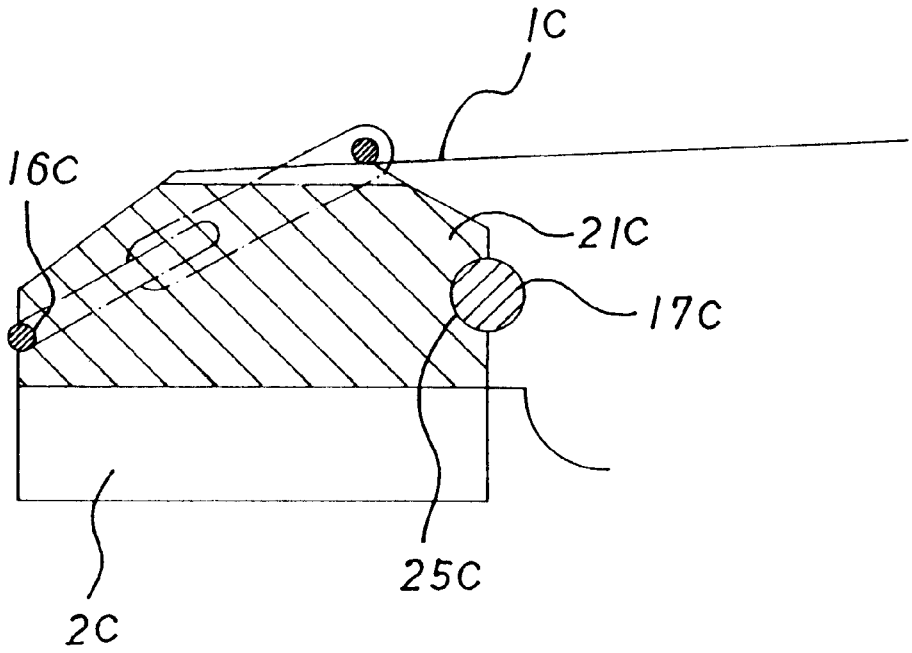
FIG. 7 is a partially sectional assembly view of a pair of pliers of a fourth preferred embodiment in accordance with the present invention.

Referring to FIGS. 6 and 7, a fourth pair of pliers comprises at least a jaw support frame 10*c* and at least a jaw block 2*c*.

The jaw block 2*c* has a mount 21*c* having a first recess 24*c* and a first groove 25*c*.

The jaw support frame 10*c* has two parallel plates 1*c*, a shaft 17*c* disposed between the parallel plates 1*c*, a hooking ring 18*c* connected to the the parallel plates 1*c*, and a spacing 100*c* defined between the parallel plates 1*c*.

The mount 21*c* is inserted in the corresponding spacing 10*c* of the jaw support frame 10*c*.

Each of the plates 1*c* has a second recess 16*c*.

The shaft 17*c* is inserted in the first groove 25*c* of the mount 21*c*.

The hooking ring 18*c* is inserted in the second recess 16*c* of the plate 1*c*.

Figure 8:
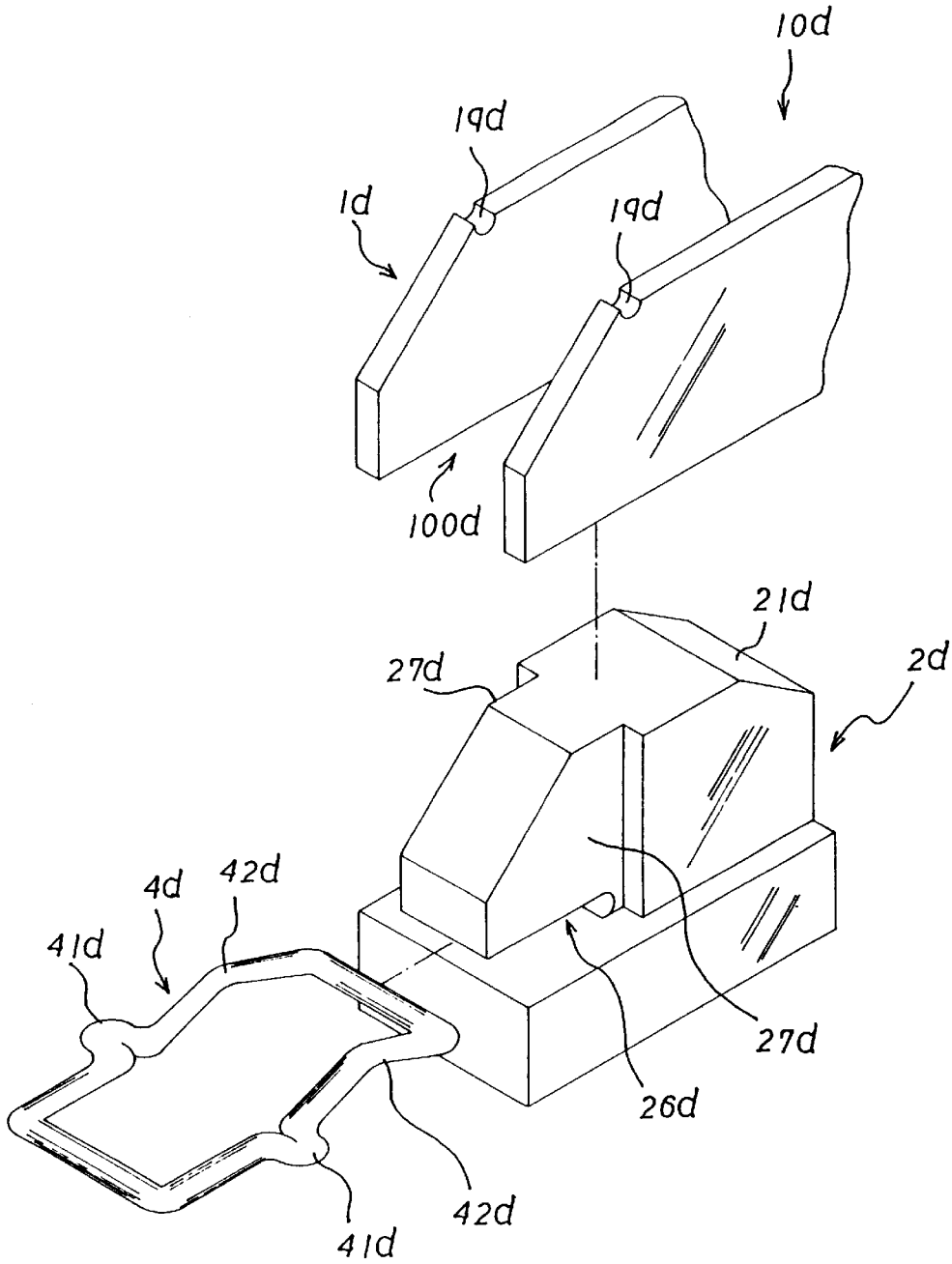
FIG. 8 is a partially perspective exploded view of a pair of pliers of a fifth preferred embodiment in accordance with the present invention.
Figure 9:
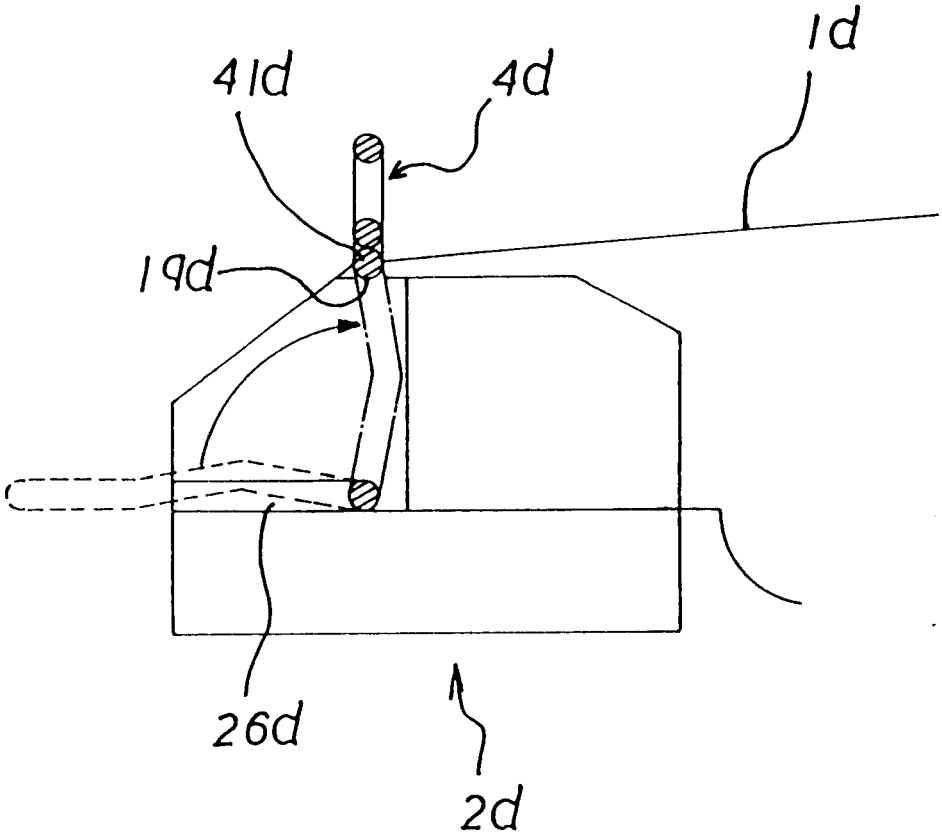
FIG. 9 is a schematic view illustrating an operation of a pair of pliers of a fifth preferred embodiment in accordance with the present invention.

Referring to FIGS. 8 and 9, a fifth pair of pliers comprises at least a jaw support frame 10*d* and at least a jaw block 2*d*.

The jaw block 2*d* has a mount 21*d* having two recesses 24*d* and a slot 26*d*.

The jaw support frame 10*d* has two parallel plates 1*d* and a spacing 100*d* defined between the parallel plates 1*d*.

The mount 21*d* is inserted in the corresponding spacing 100*d* of the jaw support frame 10*d*.

Each of the plates 1*d* has a groove 19*d*.

A flexible ring 4*d* is inserted in the slot 26*d* of the mount 21*d*.

The flexible ring 4*d* has two protruded blocks 41*d* and two curved portions 42*d*.

The invention is not limited to the above embodiment but various modification thereof may be made. Further, various changes in form and detail may be made without departing from the scope of the invention.

I claim:

1. A pair of pliers comprises:

a pair of jaw support frames engaging with each other, with each said jaw support frame having two parallel plates and a spacing defined between the parallel plates, wherein each said plate has two through holes and two threaded apertures;

two jaw blocks, with each jaw block having a mount with two blind holes;

with each jaw support frame including:

a panel having two threaded holes, an oblong recess, and an oblong groove;

a spring inserted in the oblong recess of the panel;

an oblong bar inserted in the oblong recess and the oblong groove of the panel, with the oblong bar having two recess holes; and two balls inserted in the through holes of one of the plates, with the panel and one of the plates being fastened together, with the two balls removably engaged with the two blind holes of the mount of the jaw block.

* * * * *